US006085180A

United States Patent [19]

Beer et al.

[11] Patent Number: 6,085,180

[45] Date of Patent: Jul. 4, 2000

[54] METHOD AND APPARATUS FOR CONTROLLING USE OF THE DOWNLOADING OF GRAPHICAL IMAGES FROM A PORTABLE DEVICE INTO A POSTAGE METERING SYSTEM

[75] Inventors: Terence G. Beer, Norwalk; Henry Bleggi, Fairfield; Yakup J. Igval, Milford; Louis J. Loglisci, Stamford; Richard P. Schoonmaker, Wilton; John A. Toto, Milford, all of Conn.

[73] Assignee: Pitney Bowes Inc., Stamford, Conn.

[21] Appl. No.: 08/996,601

[22] Filed: Dec. 23, 1997

[51] Int. Cl.[7] ..... G07B 17/00

[52] U.S. Cl. ..... 705/401

[58] Field of Search ..... 705/401, 408, 705/410; 283/71; 101/71; 235/375

[56] References Cited

U.S. PATENT DOCUMENTS 4,802,218 1/1989 Wright et al. ..... 380/23
4,900,904 2/1990 Wright et al. ..... 235/381
5,471,925 12/1995 Heinrich et al. ..... 705/408
5,490,077 2/1996 Freytag et al. ..... 705/405
5,602,743 2/1997 Freytag ..... 705/408

*Primary Examiner*—Edward R. Cosimano
*Assistant Examiner*—Thomas A. Dixon
*Attorney, Agent, or Firm*—Steven J. Shapiro; Michael E. Melton

[57] ABSTRACT

A system controls the downloading of images from a portable device into a postage meter so that the downloaded images can be subsequently printed by the postage meter. The portable device is useable in conjunction with a fixed number of meter serial numbers and can be used for downloading of images into any meter until the fixed number has been met and accounted for by the portable device. At this point in time, the portable device is only capable of downloading the image into the specific meters that previously had the images downloaded from the portable device.

7 Claims, 3 Drawing Sheets

METHOD AND APPARATUS FOR CONTROLLING USE OF THE DOWNLOADING OF GRAPHICAL IMAGES FROM A PORTABLE DEVICE INTO A POSTAGE METERING SYSTEM

BACKGROUND OF THE INVENTION

This instant invention relates to postage metering systems which can have graphical images downloaded therein via a portable device, and more particularly, to a method for controlling the use of the portable device as a mechanism for downloading graphical images into postage metering systems.

Known postage meters print an indicium, which is indicative of postal value dispensed by a postage meter, together with an adjacent advertising slogan or other type of graphical/descriptive image. The image printed next to the indicium usually is used for advertising purposes but can also simply be any type of message, figure and/or greeting. In one known postage meter product known as the Personal Post Office™, the graphical images which are printed together with the indicium can be installed in the postage meter by the meter manufacturer at the time of manufacture. Alternatively, these images can be downloaded from a portable device having the images stored therein (such as a smart card) into memory of the postage meter. The portable device is designed to be inserted into the postage meter to permit communication therebetween to accomplish the image download. Thus, even if the customer receives its postage meter without graphical images stored therein, they can subsequently pay for and order a smart card from the meter manufacturer which will have the desired number of images stored in memory file locations therein. In operation, once the operator has paid the meter manufacturer for the smart card with the desired images, the received smart card is inserted into the postage meter and the images are downloaded from the smart card into memory locations of the postage meter printhead module. However, once the downloading operation has been completed, the images stored in the smart card are rendered to be not readable. This ensures that the smart card can only be used for downloading the images into a single meter and not for downloading the images into a plurality of meters since the use of such smart card in connection with a single meter has only been paid for. Furthermore, to ensure that the smart card is not misused, the customer receives a monetary credit after the downloading of the graphical image if it returns the smart card back to the meter manufacturer.

While the above system has been quite satisfactory, a problem arises when a printhead module of a specific postage meter needs to be replaced. That is, as discussed above, the downloaded graphic image is stored within the memory of the printhead module. Accordingly, if a printhead module that previously was loaded with a graphic image is replaced due to failure, the current process set forth above does not allow the customer to re-load the graphics originally purchased into the printhead module. Accordingly, to overcome the above problem a costly infrastructure could be developed to maintain detailed records of individual smart card usage in connection with particular postage meters and particular printhead modules in order to credit a customer for the above printhead replacement situation discussed above. However, even if such an infrastructure were put in place, a new smart card would have to be reissued or the paid for images would have to be loaded into the replacement printhead module by the meter manufacturer. Implementation of such an infrastructure would be costly to implement and maintain.

SUMMARY OF THE INVENTION

It is thus an objective of the invention to provide a method and apparatus for controlling the use of downloading of graphical images from a portable device into a postage metering system while at the same time providing the customer with the capability of re-loading graphics into a postage meter.

The above object is met by providing a system for controlling the downloading of images to be printed by postage meters into the postage meters, the system including a portable storage device having a first memory in which at least one image is stored and a plurality of file locations in the first memory designated for receiving postage meter identifying data; a postage meter having a second memory in which data uniquely identifying the postage meter is stored, a third memory, and structure for removeably receiving and communicating with the portable storage device at times when the portable storage device is in the receiving and communicating structure; and apparatus for 1) determining if the data uniquely identifying the postage meter matches any postage meter identifying data stored in any of the plurality of file locations, 2) at times when the data uniquely identifying the postage meter matches any postage meter identifying data stored in any of the plurality of file locations downloading the image from the first memory into the third memory such that the image in the third memory of the postage meter is retrievable for printing of the image by the postage meter; 3) at times when the data uniquely identifying the postage meter does not match any postage meter identifying data stored in any of the plurality of file locations determining if any of the plurality of file locations do not have postage meter identifying data stored therein, 4) if at least one of the plurality of file locations is identified as not having postage meter identifying data stored therein loading the data uniquely identifying the postage meter into the at least one of the plurality of file locations and downloading the image from the first memory into the third memory of the postage meter such that the image in the third memory of the postage meter is retrievable for printing of the image by the postage meter, and 5) if at least one of the plurality of file locations does not have postage meter identifying data stored therein preventing the downloading of the image from the portable storage device into the third memory of the postage meter.

Objects and advantages of the invention are set forth in the description, which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT INVENTION

Figure 1:
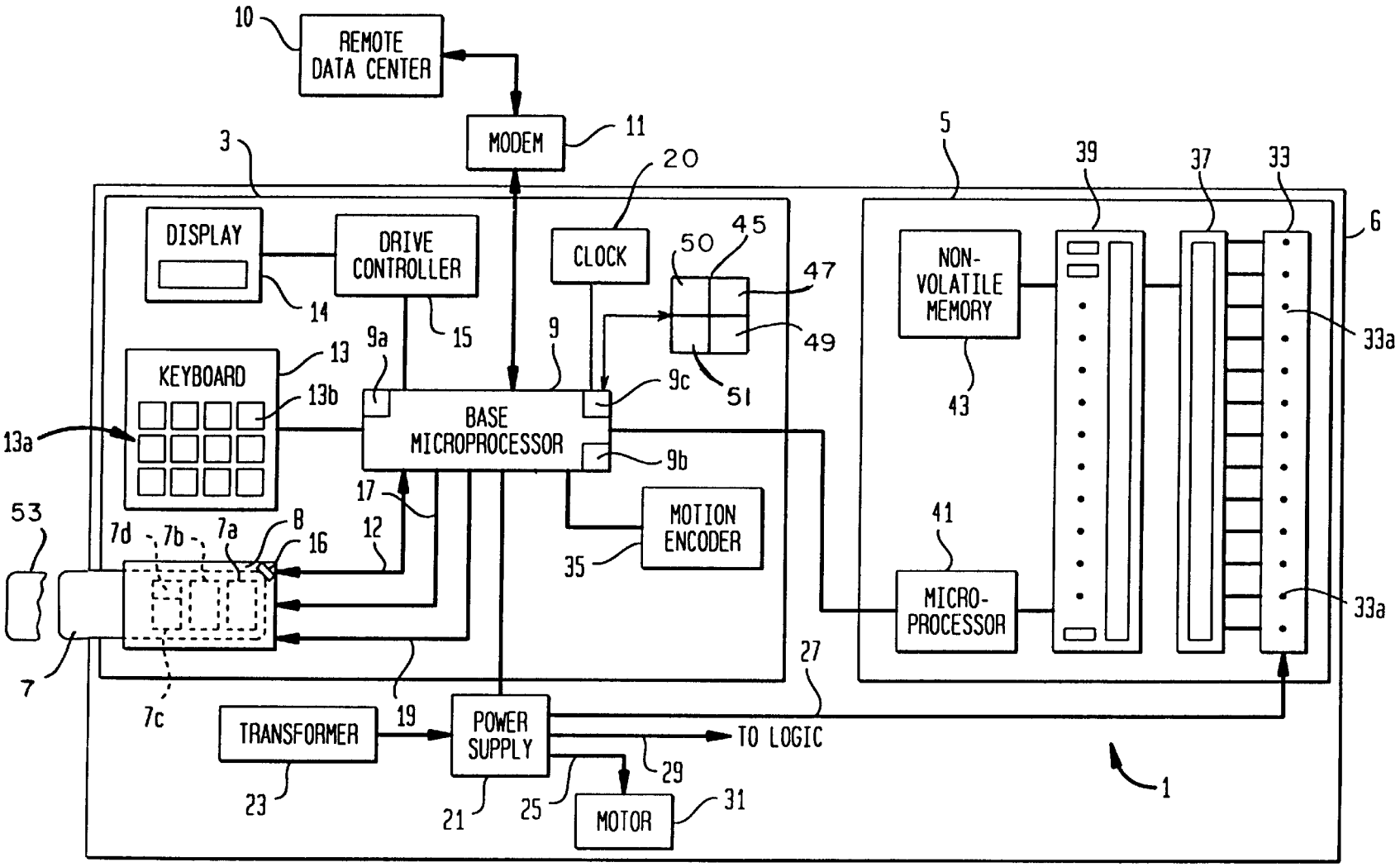
FIG. 1 is a sc hematic diagram of a postage metering system incorporating the claimed invention.

Referring to FIG. 1, a postage meter 1 includes two primary modules, a base module 3 and a printhead module 5 each of which are contained within a housing defining a single transaction terminal 6. Base module 3 includes a smart card reader 8 which receives a removable smart card vault 7, and a transaction or base microprocessor 9. Smart card vault 7 has a central processing unit 7*a*, RAM 7*b*, and non-volatile memory (NVM) 7*c* which together with the operating programs stored in ROM 7*d* allow the smart card vault 7 to perform the accounting functions of postage meter 1. That is, smart card vault 7 has the capability to have securely downloaded therein, from a remote data center 10, a predetermined amount of postage funds by securely communicating with data center 10 via a modem 11 and transaction microprocessor 9. Furthermore, during each postage transaction, smart card vault 7 checks to see if sufficient funds are available. If sufficient funds are available, smart card vault 7 debits the amount from a descending register, adds the amount to an ascending register, and sends the postage amount to the printhead module 5 via the transaction microprocessor 9. The ascending and descending registers while not shown are within NVM 7*c*. Transaction microprocessor 9 also sends date data to the printhead module 5 so that a conventional postal indicia image can be printed on a mailpiece.

Smart card vault 7 thus manages the postage funds with the ascending register representing the lifetime amount of postage funds spent, the descending register representing the amount of funds currently available, and a control sum register representing the running total amount of funds which have been credited to smart card vault 7. Additional features of smart card vault 7 which can be included are a piece counter register, encryption algorithms for encoding the information sent to the printhead module 5, and software for requiring a user to input a personal identification number which must be verified by the vault microprocessor 7 prior to its authorizing a postage transaction.

Transaction microprocessor 9 acts as a traffic cop in coordinating and assisting in the transfer of information along data line 12 between the vault microprocessor 7 and the printhead module 5, as well as coordinating various support functions necessary to complete the metering function. Transaction microprocessor 9 includes RAM 9*a*, ROM 9*b*, and central processing unit 9*c* to provide for the effective execution of meter operating programs stored in ROM 9*b* to accomplish the meter coordinating functions discussed above. Transaction microprocessor 9 also interacts with keyboard 13 to transfer user information input through keyboard keys 13*a* (such as PIN number, postage amount) to smart card vault 7. Additionally, transaction microprocessor 9 sends data to a liquid crystal display 14 via a driver/controller 15 for the purpose of displaying user inputs or for prompting the user for additional inputs. Moreover, base microprocessor 9 provides power and a reset signal to vault microprocessor 7 via respective lines 17, 19 upon detection of the insertion of smart card vault 7 into card reader 8 by a conventional electrical switch 16. A clock 20 provides date and time information to transaction microprocessor 9. Alternatively, clock 20 can be eliminated and the clock function can be accomplished by the transaction microprocessor 9.

Postage meter 1 also includes a conventional power supply 21 which conditions raw A.C. voltages from a wall mounted transformer 23 to provide the required regulated and unregulated D.C. voltages for the postage meter 1. Voltages are output via lines 25, 27, and 29 to a printhead motor 31, printhead 33 and all logic circuits. Motor 31 is used to control the movement of the printhead relative to the mailpiece upon which an indicia is to be printed. Base microprocessor 9 controls the supply of power to motor 31 to ensure the proper starting and stopping of printhead 33 movement after smart card vault 7 authorizes a transaction.

Base module 3 also includes a motion encoder 35 that processes the movement of the printhead motor 31 so that the exact position of printhead 33 can be determined. Signals from motion encoder 35 are sent to printhead module 5 to coordinate the energizing of individual printhead elements 33*a* in printhead 33 with the positioning of printhead 33. Alternatively, motion encoder 35 can be eliminated and the pulses applied to stepper motor 31 can be counted to determine the location of printhead 33 and to coordinate energizing of printhead elements 33*a*.

Printhead module 5 includes printhead 33, a printhead driver 37, a drawing engine 39 (which can be a microprocessor or an Application Specific Integrated Circuit (ASIC)), a microprocessor 41 and a non-volatile memory 43. NVM 43 has stored therein image data of the fixed indicia and image data for each individual font that can be required as part of the variable data. Microprocessor 41 receives a print command, postage amount, and date via the transaction microprocessor 9. The postage amount and date are sent from microprocessor 41 to the drawing engine 39 which then accesses nonvolatile memory 43 to obtain image data therefrom which is then downloaded by the drawing engine 39 to the printhead driver 37 in order to energize individual printhead elements 33*a* to produce a single column dot pattern of the indicia. The individual column-by-column generation of the indicia is synchronized with movement of printhead 33 until the full indicium is produced.

In addition to portable postage vault 7, a second postage meter vault 45 (including an NVM 47, RAM 49, ROM 50 and CPU 51) can be included in base module 3. Vault 45 operates in an identical manner to portable vault 7 except that it is not designed to be removable. Rather, vault 45 acts as a base module vault which accounts for postage dispensed whenever a portable postage vault 7 is not inserted into base module 3. Thus, as described in U.S. Pat. No. 5,731,980 and entitled "ELECTRONIC POSTAGE METER SYSTEM HAVING INTERNAL ACCOUNTING SYSTEM AND REMOVABLE EXTERNAL ACCOUNTING SYSTEM", which is hereby incorporated by reference, when a portable vault 7 is inserted into the base module 3, the postage metering system automatically defaults to the portable postage vault 7 for the accounting of postage dispensed. This dual vault metering system allows for operation of the postage meter 1 in a conventional manner without a portable vault 7 by utilizing the internal vault 45 while at the same time permitting the use of external portable vaults 7 for the benefits previously discussed.

Figure 2:
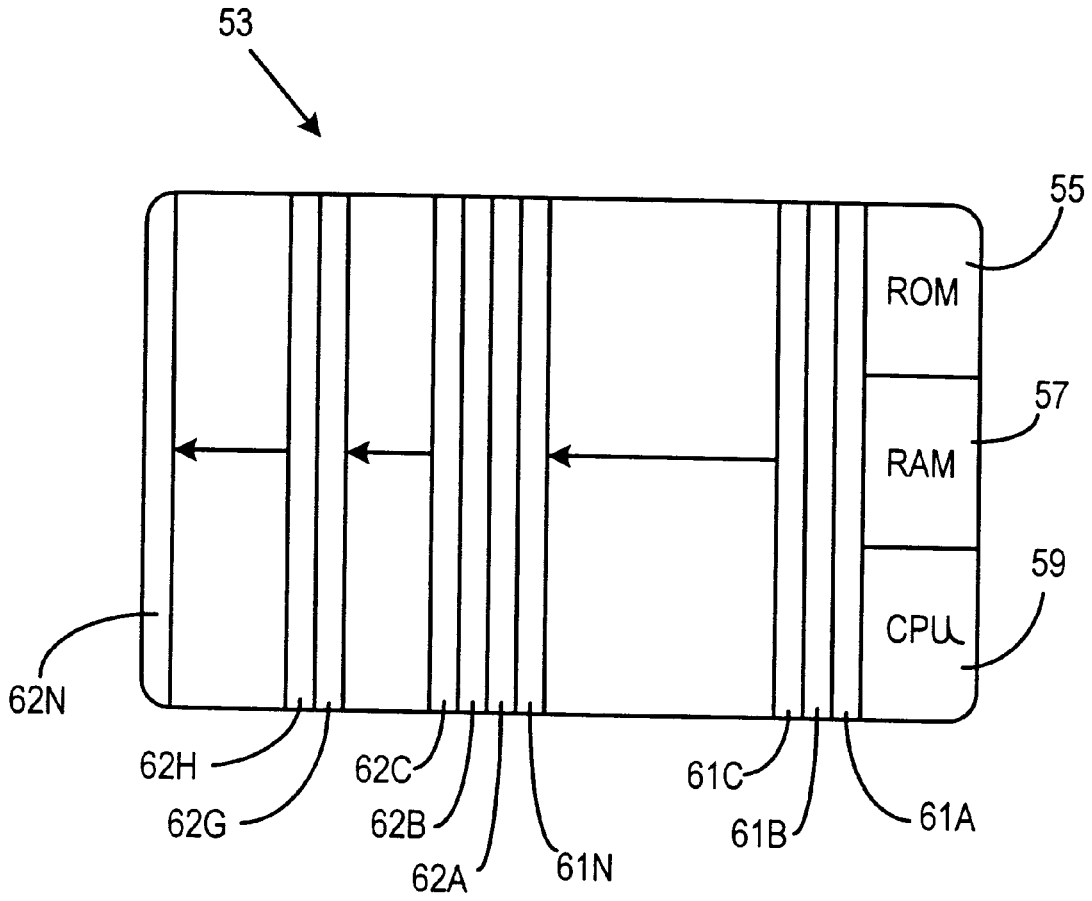
FIG. 2 is a portable storage device.

Additionally, instead of portable vault 7 a portable smart card image storage device 53 can be inserted into card reader 8 to permit communication between base microprocessor 9 and storage device 53. Referring to FIG. 2, storage device 53 is a smart card having a ROM 55, a RAM 57, a CPU 59 and non-volatile memory (NVM) 61. NVM 61 includes a plurality of files (registers) 61A to 61N which are used to store images which are to be downloaded into NVM 43 of printhead module 5, as discussed in more detail below. Additionally, NVM 61 also includes a second plurality of files 62A to 62N which are used to store postage meter serial numbers and which can be divided into a first set 62A to 62G and a second set 62H to 62 N for purposes to be discussed below.

Figure 3:
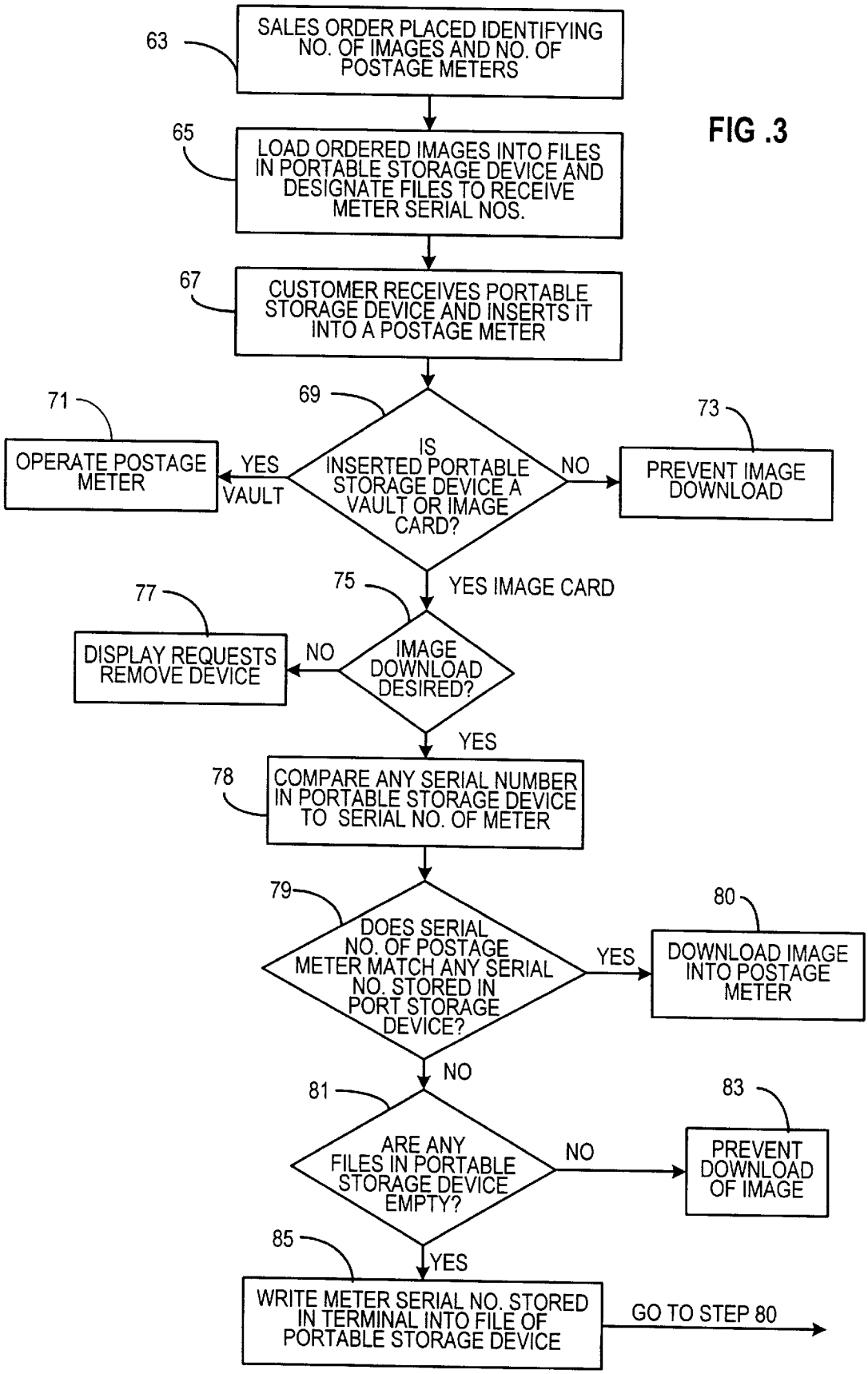
FIG. 3 is a flow chart of the operation of the postage metering system of FIG. 1.

Referring to FIG. 3, a flow chart of the inventive method is shown. At step 63, an order is placed with a meter manufacturer for a storage device 53 having a predetermined number of selected images stored therein which are being licensed for downloading into a predetermined number of postage meters. At step 65, the meter manufacturer upon receipt of the order loads the ordered images into the number of files 61A to 61N needed to store the ordered images. At the same time, the meter manufacturer also designates a predetermined number of files, such as files 62A to 62G into which a meter serial number can be written. The number of files 62A to 62G would match the predetermined number of postage meters for which the user has paid to have the selected images downloaded into. Files 62H to 62N are then designated for non-use. At step 67 the customer receives the storage device 53 and inserts it into the card reader 8 of postage meter terminal 6. Base microprocessor 9 then communicates with storage device 53 to determine the type of card which has been inserted into reader 8 (step 69). That is, the communication between the storage device 53 and the base microprocessor 9 determines if the inserted card is a portable vault 7, a portable storage device 53 or neither. If the inserted card is a portable vault 7, at step 71 the postage meter 1 is enabled to operate as a postage meter using the portable vault for accounting. On the other hand, if the inquiry at step 69 cannot identify the inserted card, operation of the postage meter 1 is not enabled and no downloading of images into NVM 43 occurs (step 73). Finally, if the inquiry at step 69 is that the inserted card is a portable storage device 53, base microprocessor 9 queries the user via a message in display 14 as to whether they wish to download the stored images of the portable storage device into the postage meter 1 (step 75). The user responds via the keyboard 13 as to whether the image download is to be completed. If the answer is NO, the postage meter displays a message via display 14 requesting that the inserted card be removed (step 77). If however, the answer to the inquiry at step 75 is YES, the base microprocessor 9 obtains any postage meter serial numbers which are stored in files 62A to 62G and compares those serial numbers to a postage meter serial number stored within terminal 6 (step 78). At step 79 a determination is made if the serial no. of the postage meter matches any serial number in the portable device. The serial number of terminal 6 can be stored in any number of places including ROM 95, ROM 50, or MVM 47. If any of the postage meter serial numbers stored in files 62A to 62G match the serial number stored in terminal 6, base microprocessor 9 obtains the images stored in files 61A to 61N and downloads these images into NVM 43 of printhead module 6 so that they can subsequently be selectively printed together with a postage indicium in a conventional manner.

On the other hand, if the answer at step 79 is NO, base microprocessor 9 determines if any of the files 61A to 61G are empty (do not have a serial number therein) (step 81). If no such files are available, base microprocessor 9 displays a message on display 14 which informs the user that the stored images cannot be downloaded into the postage meter 1 (step 83). Alternatively, if there is at least one empty file 62A to 62G, base microprocessor 9 will write the meter serial number stored in terminal 6 into the empty file in the storage medium device 53 (step 85) and completes the download of the image into NVM 43. Thus, if the licensed images ever need to be reloaded from the inserted card 53 into the same postage meter 1 again, the answer at step 79 will be YES and downloading of the images will be permitted.

It is thus readily apparent that the inventive method and apparatus overcome the problem discussed above in that once a specific postage meter 1 has images from a particular storage device 53 downloaded into it, the storage device 53 is flagged with the specific postage meter serial number allowing reloading of the images from that particular storage device 53 into that specific postage meter any time in the future. Thus, even if a new printhead module 5 is inserted into the specific postage meter 1 such that it requires new image data to be loaded into its memory 43, the storage device 53 will permit such reload to occur. This self regulating feature does not require any special data base infrastructure which would require the tracking of each and every storage device 53 and its use in connection with specific postage meters 1 and printhead modules 5. Furthermore, the customer is now able to predesignate a specific number of postage meters 1 it would like to license the images for while at the same time not being required to initially link use of the storage device 53 to specific postage meter serial numbers. The customer has the flexibility over time of choosing which of a plurality of postage meters in his possession shall have the images downloaded therein. It is only when an actual download occurs that one of the serial number files 62A to 62N has the specific postage meter serial number written into it.

An additional feature related to files 62 H to 62 N is as follows. Previously it was stated that these files 62H to 62 N were designated for non-use. However, in the situation where a customer later desires to have the images stored in his portable device 53 downloaded into additional postage meters 1 and no files 62A to 62G are available, further image downloading into non-designated postage meters 1 cannot occur. In this situation however, the user can contact the meter manufacturer to request that the storage device 53 be useable on a specific number of meters. The storage device 53 can have its own serial number associated therewith such that the remote data center 10 flags that additional ones of files 62H to 62N for that specific storage device serial number should be designated for use to receive meter serial numbers. When the portable device 53 is then inserted into the postage meter 1 the display 14 will still reflect that the desired download cannot occur but will query the user as to whether a request to increase the usage of the portable device 53 has been made to the data center 10. If the user responds to this query via the keyboard 14 YES, postage meter 1 establishes communication with the data center 10 providing it with the serial number of the portable storage device 53. The data center will recognize the serial number of the portable storage device 53 and will initiate the designation of the necessary number of files 62H to 62N to permit downloading of the images of storage device 53 into the requested number of additional postage meters 1.

Additional advantages and modifications will readily occur to those skilled in the art. Therefore, the invention in its broader aspects is not limited to the specific details and representative devices, shown and described herein. Accordingly, various modifications may be made without departing from the spirit or scope of the general inventive concept as defined by the appended claims.

What is claimed is:

1. A method for controlling use of a portable storage device for downloading images to be printed by postage meters into the postage meters, the method comprising the steps of:

A) storing an image in a memory of the portable storage device;

B) designating a plurality of file locations in the memory of the portable storage device each for receiving postage meter identifying data;

C) inserting the portable storage device into a postage meter to establish communication therebetween;

D) determining if postage meter identifying data stored in the postage meter matches any postage meter identifying data stored in any of the plurality of file locations;

E) at times when the postage meter identifying data stored in the postage meter matches any postage meter identifying data stored in any of the plurality of file locations downloading the image from the memory of the portable storage device into a memory of the postage meter such that the image in the memory of the postage meter is retrievable for printing of the image by the postage meter;

F) at times when the postage meter identifying data stored in the postage meter does not match any postage meter identifying data stored in any of the plurality of file locations determining if any of the plurality of file locations do not have postage meter identifying data stored therein;

G) if at step F) at least one of the plurality of file locations is identified as not having postage meter identifying data stored therein loading the postage meter identifying data stored in the postage meter into the at least one of the plurality of file locations and downloading the image from the memory of the portable storage device into the memory of the postage meter such that the image in the memory of the postage meter is retrievable for printing of the image by the postage meter; and H) if at step F) all of the plurality of file locations have postage meter identifying data stored therein preventing the downloading of the image from the portable storage device into the memory of the postage meter.

2. A method as recited in claims 1, wherein during steps E) and G) wherein the memory of the postage meter into which the image is downloaded is housed in a printhead module of the postage meter.

3. A method as recited in claim 1, further comprising initially designating another plurality of file locations in the memory of the portable storage device not to be able to receive postage meter identifying data and subsequently upon request re-designating at least some of the another plurality of file locations to be able to receive postage meter identifying data.

4. A method as recited in claim 3, wherein the portable storage device is a smart card.

5. A system for controlling the downloading of images to be printed by postage meters into the postage meters, the system comprising:

a portable storage device having a first memory in which at least one image is stored and a plurality of file locations in the first memory designated for receiving postage meter identifying data;

a postage meter having a second memory in which data uniquely identifying the postage meter is stored, a third memory, and means for removeably receiving and communicating with the portable storage device at times when the portable storage device is in the receiving and communicating means; and means for 1) determining if the data uniquely identifying the postage meter matches any postage meter identifying data stored in any of the plurality of file locations, 2) at times when the data uniquely identifying the postage meter matches any postage meter identifying data stored in any of the plurality of file locations downloading the image from the first memory into the third memory such that the image in the third memory of the postage meter is retrievable for printing of the image by the postage meter; 3) at times when the data uniquely identifying the postage meter does not match any postage meter identifying data stored in any of the plurality of file locations determining if any of the plurality of file locations do not have postage meter identifying data stored therein, 4) if at least one of the plurality of file locations is identified as not having postage meter identifying data stored therein loading the data uniquely identifying the postage meter into the at least one of the plurality of file locations and downloading the image from the first memory into the third memory of the postage meter such that the image in the third memory of the postage meter is retrievable for printing of the image by the postage meter, and 5) if all of the plurality of file locations have postage meter identifying data stored therein preventing the downloading of the image from the portable storage device into the third memory of the postage meter.

6. A system as recited in claim 5, wherein the postage meter further includes a printhead module and the third memory is part of the printhead module.

7. A system as recited in claim 6, wherein the portable storage device is a smart card.

* * * * *